US005277663A

United States Patent [19]

Lemme et al.

[11] Patent Number: 5,277,663

[45] Date of Patent: Jan. 11, 1994

[54] BELT DRIVE FOR AN INTERNAL-COMBUSTION ENGINE

[75] Inventors: Werner Lemme, Roesrath; Lothar Bauer, Cologne, both of Fed. Rep. of Germany

[73] Assignee: Kloeckner-Humboldt-Deutz AG, Cologne, Fed. Rep. of Germany

[21] Appl. No.: 725,435

[22] Filed: Jul. 3, 1991

[30] Foreign Application Priority Data

Jul. 3, 1990 [DE] Fed. Rep. of Germany ..... 4021175

[51] Int. Cl.[5] ..... F16H 57/04

[52] U.S. Cl. ..... 474/93; 474/146, 148, 150; 74/606 A

[58] Field of Search ..... 474/93, 144–; 74/606

[56] References Cited

U.S. PATENT DOCUMENTS 2,696,074 12/1954 Dolza ..... 74/606 A X
3,859,965 1/1975 Hatz et al. ..... 123/41.66 X
3,926,155 12/1975 Hatz et al. ..... 123/41.68
4,422,498 12/1983 Chen ..... 474/93 X
4,497,285 2/1985 Kondo ..... 74/606 A X

FOREIGN PATENT DOCUMENTS 1236276 3/1967 Fed. Rep. of Germany .
2265214 12/1976 Fed. Rep. of Germany ..

*Primary Examiner*—Ramon S. Britts
*Assistant Examiner*—Rober J. Schoeppel
*Attorney, Agent, or Firm*—Charles L. Schwab

[57] ABSTRACT

A connecting passageway is provided between a cooling air fan and an enclosure for an enclosed belt drive of an internal-combustion engine, whereby the belt drive is cooled by a cool-air stream diverted from the cooing fan.

The connecting passageway is made as an air shaft, which is formed largely from existing parts of the internal-combustion engine and, in addition, is arranged in such a fashion that it has no parts protruding beyond the outer counter of the engine.

3 Claims, 2 Drawing Sheets

BELT DRIVE FOR AN INTERNAL-COMBUSTION ENGINE

TECHNICAL FIELD

This invention relates to cooling of an enclosed belt drive of an internal combustion engine.

INFORMATION DISCLOSURE STATEMENT

An enclosed belt drive is known from German patent DE-PS 94 82 07. In that prior art belt drive, a cool-air stream diverted from the cooling fan is diverted from behind the first cylinder and is introduced into the belt enclosure via a connecting line and a filter means. It is disadvantageous that the cool-air stream is not diverted until after it has passed by the first cylinder, because the cool-air stream at this location is already heated by the amount of waste heat absorbed from the first cylinder and thus the full cooling capacity is no longer available for the cooling of the belt drive. This type of withdrawal of a cool-air stream also contributes to unfavorable cooling of the cylinders, because the first cylinder is cooled particularly intensively and the subsequent cylinders are cooled with a quantity of cool air diminished by the diverted cool-air stream. Furthermore, the connecting line, as a self-supporting line, is susceptible to damage due to external influences and due to vibrations of the internal-combustion engine and, because of its large space requirement, governs the upper outline of the internal-combustion engine.

OBJECTS AND BRIEF DESCRIPTION OF THE INVENTION

It is an object of the invention to create an enclosed belt drive of an internal-combustion engine that, on the one hand, provides for effective cooling of the belt drive without impairment of the cooling of the cylinders and, on the other hand, is arranged in such a fashion as to save space and not be susceptible to damage.

In accordance with the invention, this object is achieved by virtue of the fact that the connecting line or passageway is made as an air shaft, which in the region of the cooling fan is formed by a flange surrounding the cooling fan and by a part of the adjoining cylinder head and is continued via a housing part sealingly connected to the flange surrounding the cooling fan, which housing part adjoins an air inlet opening of the belt enclosure. Thus, the disadvantages described above are avoided and, in addition, a simply constructed connecting passageway is made possible. The danger of damage is very slight by virtue of the integrated arrangement of the connecting passageway. By virtue of the direct withdrawal of the cool-air stream in the region of the cooling fan, the cool air is not yet heated, and in the cylinder cooling there are no differences in the quantity of cool air.

In a further development of the invention, the filter means is formed by two baffles, which are arranged in the flange surrounding the cool-air fan and in the housing part. The baffles can be integrally cast or injection-molded with the respective parts so that the cost of fabrication is very low.

In accordance with the invention, the housing part is fabricated from plastic and can thus be fabricated in an easy and uncomplicated fashion, with little weight.

This dust-free and effective cooling can be employed, in particular, in the case of a toothed belt that drives, for example, a camshaft or injection pump of an auto-ignition internal-combustion engine.

In a further development of the invention, a second air shaft or passageway is arranged next to the first one to provide cool air to a second belt. Said second belt is preferably again a toothed belt, which, however, drives auxiliary devices such as, for example, hydraulic pumps. Effective cooling of the toothed belt is indispensable especially when virtually the entire useful power of an internal-combustion engine is utilized for the driving of hydraulic pumps. The second air shaft is designed in very largely the same fashion as the first air shaft and, in particular, provision is made to provide a dual-passage, one-piece housing part for the transport of cool air.

Further advantages of the invention can be understood from the description of the drawing, in which an exemplary embodiment of the invention, illustrated in the Figures, is described.

DETAILED DESCRIPTION OF THE DRAWINGS

Figure 1:
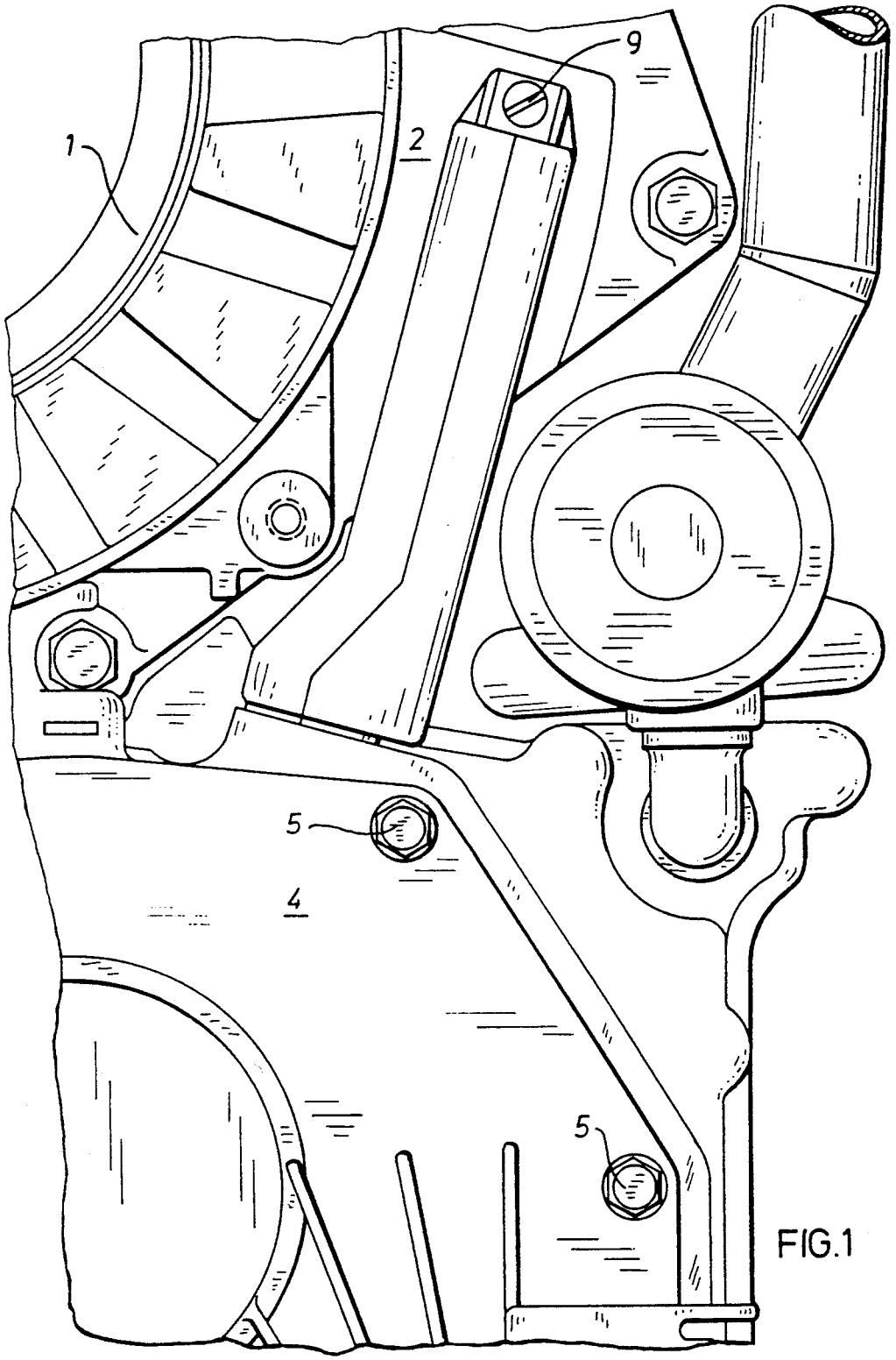
FIG. 1 shows a top view of a connecting line.
Figure 2:
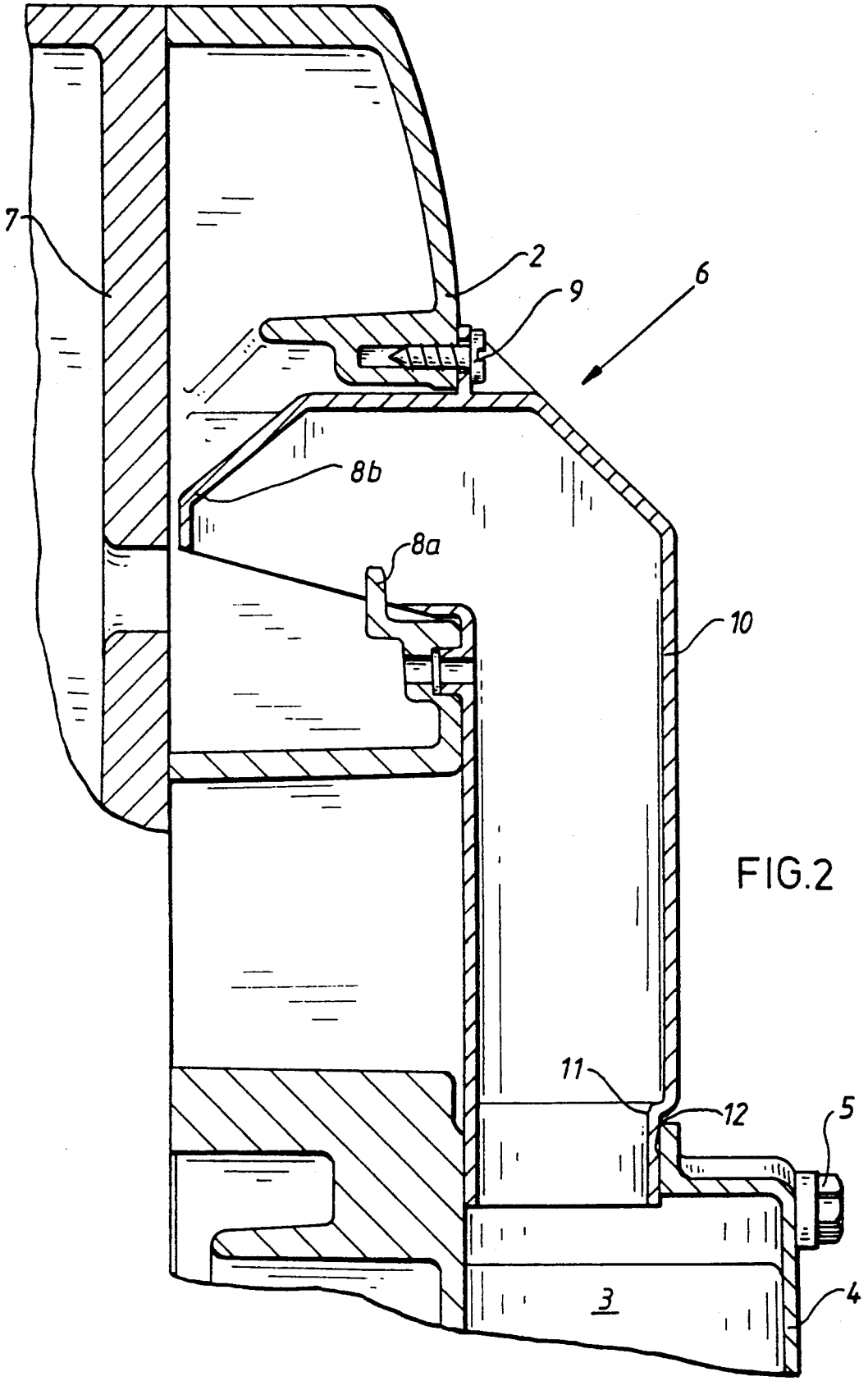
FIG. 2 shows a cross section through the connecting line.

An auto-ignition internal-combustion engine, not further illustrated, has a cool-air fan 1, which is utilized for the cooling of components of the internal-combustion engine and/or of a heat exchanger or of the medium located therein. The cool-air fan 1 is bordered by a cooling-fan duct, which has a flange 2 surrounding the cooling fan. The internal-combustion engine has a crankshaft, not shown, which transforms the reciprocating motion generated by the pistons of the internal-combustion engine into rotary motion. On the front end of the crankshaft there is mounted at least one pulley 3 for a toothed belt, which pulley, via a toothed belt, drives the camshaft of the internal-combustion engine or, simultaneously, the drive shaft of the injection pump or of the injection-pump elements. The toothed-belt pulley 3 and the toothed belt are covered by a belt enclosure 4, which is attached to the internal-combustion engine by means of screws 5. A connecting passageway includes an air shaft 6, which is formed in the region of the cooling fan 1 by the flange 2 surrounding the cooling fan and by a part of the adjoining cylinder head 7. A first fin in the form of a baffle **8*a* is cast integrally with the flange 2 surrounding the cooling fan, which flange is fabricated by the die-casting process. By means of a screw connection 9, a housing part 10, which forms a further air shaft, is attached to the flange 2 surrounding the cooling fan. The housing part 10 has, in the region of the screw connection 9, a baffle 8*b*, which is integrally injection-molded with the housing part 10. On the opposite end, the housing part 10 has a constriction 11, which extends into and engages into a cool-air inlet opening 12 of the belt enclosure 4**.

The embodiments of the invention in which an exclusive property or privilege is claimed are defined as follows:

1. In an internal combustion engine having a cylinder head (7), a cooling air fan (1) for delivering a cooling air stream and a belt drive enclosed within a belt enclosure (4), means for diverting a part of said cooling air stream from said cooling air fan (1) to the belt enclosure (4) comprising: a flange (2) adjacent said cylinder head (7), said flange surrounding said cooling air fan, an air inlet opening in said belt enclosure, a connecting passageway between said cooling air fan and said air inlet opening including an air shaft (6), which in the region of said cooling air fan (1) is formed by said flange (2) surrounding said cooling air fan and by a part of said adjoining cylinder head (7) and is continued via a housing part (10) releasably and sealingly connected to said flange (2) surrounding said cooling air fan, said housing part (10) being releasably connected to said air inlet opening (12) of said belt enclosure (4), said housing part (10) being spaced from said cylinder head (7) and operative to direct a cooling air stream from said cooling air fan (1) away from said cylinder head (7) and to said belt enclosure (4) without first cooling other engine components.

2. The combination of claim 1, and further comprising a first baffle (8*a*) formed in said flange (2) surrounding said cooling air fan and a second baffle (8*b*) formed in said housing part (10), said baffles (8*a*, 8*b*) constituting a filter for cooling air entering said connecting passageway.

3. The combination of claim 1 wherein said means for diverting a cooling air stream includes a second air shaft arranged next to said first air shaft for delivering a cooling air supply to a second belt drive.

* * * * *